United States Patent [19]

Kato

[11] 3,993,416

[45] Nov. 23, 1976

[54] FUEL TANK ASSEMBLY AND A METHOD OF CONSTRUCTING SAME

[75] Inventor: Shinichi Kato, Toyota, Japan

[73] Assignee: Toyota Jidosha Kogyo Kabushiki Kaisha, Toyota, Japan

[22] Filed: May 29, 1975

[21] Appl. No.: 581,733

[30] Foreign Application Priority Data

Jan. 28, 1975 Japan ..... 50-11556

[52] U.S. Cl. ..... 417/360; 417/366

[51] Int. Cl.[2] ..... F04B 39/02; F04B 39/06

[58] Field of Search ..... 417/360, 366; 222/383

[56] References Cited

UNITED STATES PATENTS

| | | | |
|---|---|---|---|
| 2,292,993 | 8/1942 | Curtis | 222/383 |
| 2,388,939 | 11/1945 | Stepanoff | 222/383 |
| 2,545,319 | 3/1951 | Sundholm | 222/383 |
| 3,316,847 | 5/1967 | Mandy et al. | 417/360 |
| 3,443,519 | 5/1969 | White | 417/366 |
| 3,507,582 | 4/1970 | Jeep et al. | 417/366 |
| 3,809,496 | 5/1974 | Hansen | 417/360 |

*Primary Examiner*—William L. Freeh
*Assistant Examiner*—G. P. LaPointe
*Attorney, Agent, or Firm*—Birch, Stewart, Kolasch & Birch

[57] ABSTRACT

A fuel tank assembly of a fuel tank and a centrifugal fuel pump, said pump being mounted outside said tank by a conduit structure, wherein an impeller of said pump is positioned below the predetermined lowest fuel level in said tank.

8 Claims, 2 Drawing Figures

FUEL TANK ASSEMBLY AND A METHOD OF CONSTRUCTING SAME

BACKGROUND OF THE INVENTION

1. Field of the Invention

The present invention relates to a method and means for mounting a fuel pump to a fuel tank, particularly a fuel tank of an automobile.

2. Description of the Prior Art

As a fuel pump for an automobile, a centrifugal pump employing an impeller is mostly used. Since a centrifugal pump has generally no substantial drawing ability, an effective pumping action is not always obtained if the pump is optionally positioned relative to the fuel tank with an inlet port of the tank being connected to an internal space of the tank by means of an optional conduit means. Conventionally, therefore, the centrifugal pump is positioned within the fuel tanks at a lower portion of the tank internal space so that the pump is steeped in a bath of fuel. Thus, fuel is automatically supplied to the inlet port of the pump due to the gravity of the liquid fuel. In this method of mounting a fuel pump to a fuel tank, a pump mounting structure such as a stay, flange, etc., must be provided within the tank, rendering the drawback that individual designs of the mounting structure, i.e. shapes and positions of the stay, flange, etc. are required for individual fuel tanks according to the variety of automobile types, thereby complicating the manufacture of fuel tank assemblies with a corresponding increase in the manufacturing cost. Nevertheless, the centrifugal fuel pump has been used because its structure is simple and compact enough to compensate for the aforementioned drawback.

SUMMARY OF THE INVENTION

It is the primary object of the present invention to counteract the abovementioned drawback with regard to the mounting of a centrifugal fuel pump and to provide an improved method of mounting a centrifugal fuel pump to a fuel tank, said method being one which is applicable to any tank regardless of its shape and dimensions.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

According to the present invention, the abovementioned object is accomplished by a method which is characterized by the mounting of the centrifugal fuel pump outside a fuel tank with its impeller being positioned below a predetermined lowest fuel level in said tank, and connecting the inlet port of said pump to an internal space portion of said tank located below said lowest fuel level.

When the pump is mounted outside the tank, the mounting structure and the manner of mounting the pump can be made uniform regardless of the kind of fuel tank while ensuring the normal operation of the centrifugal pump, by providing a positive suction head for the pump by positioning the impeller of the pump below the predetermined lowest fuel level in the tank.

To accomplish the abovementioned method of mounting a centrifugal fuel pump to a fuel tank, the present invention further proposes a fuel tank assembly which comprises a fuel tank and a centrifugal fuel pump, said pump being mounted outside said tank by a conduit structure which extends from a lower side wall portion of said tank to support said pump and connects an inlet port of an impeller chamber of said pump to an internal lower space portion of said tank. In this kind of fuel tank assembly, said conduit structure may preferably be mounted to the lower side wall portion of said tank at one end thereof by a nipple mounting structure which comprises a threaded nipple member firmly connected to the tank wall by welding and a cap nut which cooperates with said threaded nipple member to fasten said end of the conduit structure to said threaded nipple member. Alternatively, said conduit structure may be mounted to the side wall portion of said tank by a flange mounting structure in a manner that a flange portion formed at one end of said conduit structure is fastened to a seat member which is welded to the side wall portion by stud bolts and nuts.

Said conduit structure may be provided with a tubular filter element which is adapted to extend into the internal space of the tank when the conduit structure is mounted to the lower side wall portion of the tank. The tubular filter element may be mounted to the conduit structure before the latter is mounted to the tank so that when the conduit structure is mounted to the wall of the tank, the tubular filter element is passed through an opening provided at the wall of the tank to be automatically mounted to its operating position.

BRIEF DESCRIPTION OF THE DRAWING

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Figure 1:
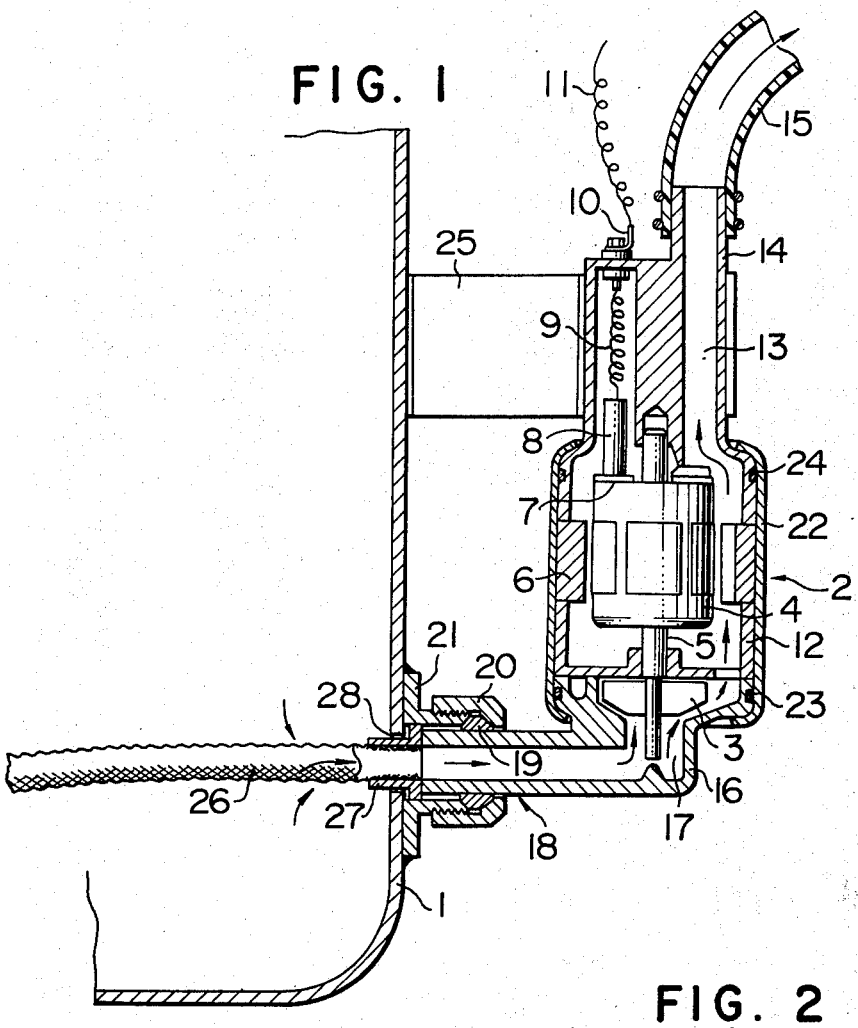
FIG. 1 is a sectional view of an essential portion of a fuel tank assembly according to the present invention; and, FIG. 2 is a sectional view of a mounting portion of the conduit structure by an alternative embodiment of the present invention.

Referring to FIG. 1, reference numerals 1 and 2 designate a fuel tank and a fuel pump, respectively. The fuel pump 2 is of a centrifugal type which has an impeller 3 adapted to be driven by an armature 4 by way of a rotary shaft 5. Around the armature 4, there are provided magnets 6 which constitute an electric motor together with the armature 4. The armature 4 has commutors 7 which are contacted by a brush 8 which is in turn connected to a terminal 10 by a wire 9. The terminal 10 is connected to an electric source (not shown) by a wire 11. A housing 12 supports the magnets 6 as well as encloses the armature 4 to constitute the electric motor. Within the housing, a flow passage 13 for allowing the flow of fuel pumped by the impeller 3 therethrough is formed. A tubular projection 14 is formed at an outlet end portion of the flow passage 13, said tubular projection being connected with the fuel pipe 15. Abutting at the lower end of the housing 12, a conduit structure 16 is provided, said structure comprising a housing portion which encloses the impeller 3 to define an impeller chamber therein and an inlet port 17 leading to said impeller chamber. The conduit structure further comprises a mounting structure 18 at the other end thereof for the mounting of the structure to a side wall portion of the tank 1. In the embodiment shown in FIG. 1, said mounting structure comprises a sleeve 19 and a cap nut 20 mounted around a tubular end portion of the conduit structure, said sleeve and nut engaging a nipple element 21 mounted at the side wall of the tank by welding, etc. By the nut 20 being screwed onto a correspondingly threaded portion of the nipple element, the sleeve 19 is compressed between the nut and the nipple element thereby firmly mounting the conduit structure 16 to the tank 1. The conduit structure 16 and the motor housing 12 are maintained in an assembled condition by an outer sleeve member 22. Elements 23 and 24 designate sealing means which maintain air tightness of the assembled housing. Furthermore, the mounted condition of the pump is auxiliarily maintained by an auxiliary stay 25 which extends between an upper portion of the fuel pump and the side wall of the tank.

In the shown embodiment, a tubular filter element 26 is mounted to extend from the end portion of the conduit structure 16. The filter element 26 comprises a flange element 27 for the convenience of its mounting. Prior to the mounting of the conduit structure 16, the filter element 26 is passed through an opening 28 provided at the side wall of the tank so that the flange element engages said opening from its outside, whereby when the conduit structure 16 is mounted to the tank as shown in FIG. 1, the flange element 27 is automatically mounted as shown in FIG. 1.

Figure 2:
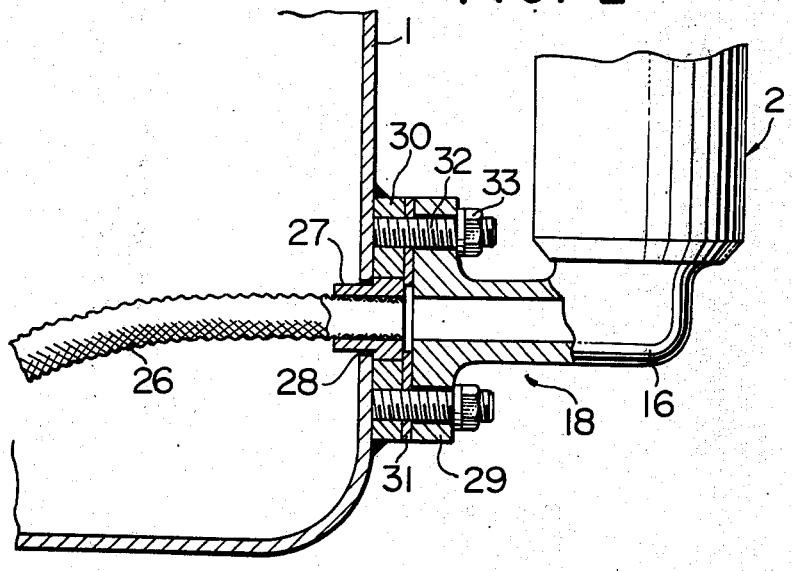

Referring to FIG. 2 which shows an alternative embodiment of the mounting portion of the conduit structure, the mounting structure 18 formed at an end of the conduit structure 16 comprises a flange 29 which is mounted onto a seat member 30 provided at the side wall portion of the tank with the interposition of a packing 31. The flange 29 is fastened at its mounting position by stud bolts 32 and nuts 33. Other portions corresponding to those shown in FIG. 1 are designated by corresponding reference numerals.

Although two favorable embodiments of the present invention have been shown and described in detail, it will be appreciated that various modifications can be made with regard to the shown embodiments without departing from the spirit and scope of the present invention.

I claim:

1. A fuel tank assembly comprising a fuel tank and a centrifugal fuel pump which possesses substantially no drawing ability, said pump being mounted on the outside of said tank by a conduit structure which extends from the lower side wall portion of said tank to support said pump and connects the inlet port of an impeller chamber of said pump to the internal lower space portion of said tank and a tubular filter element mounted to extend from the end of said conduit structure toward the internal space of said tank, said tubular filter element being provided with a flange element which is incorporated into a mounting structure for mounting said conduit structure to said side wall portion of said tank.

2. The fuel tank assembly according to claim 1, wherein said conduit structure comprises a first end portion which encloses the impeller of said centrifugal fuel pump thereby defining said impeller chamber and said inlet port leading to said impeller chamber and a second end portion which is substantially a tubular end adapted to be mounted to said side wall portion of said tank.

3. The fuel tank assembly according to claim 1, wherein said second end portion of said conduit structure is engaged with a sleeve and a cap nut which cooperate with a nipple member mounted at said side wall portion of said tank, said sleeve being compressed between said cap nut and said nipple member to be fastened around said tubular end portion of said conduit structure to firmly mount said conduit structure to said tank.

4. The fuel tank assembly according to claim 2, wherein said second end portion of said conduit structure comprises a flange which is in face-to-face relationship with a seat member mounted to the side wall portion of the tank, with the interposition of a packing, said flange being fastened to its mounting position by stud bolts and nuts.

5. The fuel tank assembly according to claim 2, wherein said first end portion of said conduit structure is joined with a housing member for an electric motor which drives said impeller, said first end portion and said housing member for the electric motor being maintained at the assembled condition by an outer sleeve member which encloses both of said first end portion and said housing member.

6. The fuel tank assembly according to claim 5, wherein said first end portion of said conduit structure and said housing member for said electric motor define a flow passage therethrough for liquid pumped by said impeller.

7. The fuel tank assembly according to claim 6, wherein said housing member includes a tubular end which defines an outlet end of said flow passage, said tubular end being adapted to be connected with a fuel pipe.

8. The fuel tank assembly according to claim 1, wherein said assembly of said pump and said tank effected by said conduit structure is reinforced by an auxiliary stay which extends between the upper portion of said tank and said side wall portion of the fuel pump.

* * * * *